US005367844A

United States Patent [19]

Diedrich

[11] Patent Number: 5,367,844

[45] Date of Patent: Nov. 29, 1994

[54] PANEL CONSTRUCTION WHICH INCLUDES SLATS OF RECYCLED PLASTIC

[75] Inventor: Lyle Diedrich, Kaukauna, Wis.

[73] Assignee: La Force Hardware & Manufacturing Co., Green Bay, Wis.

[21] Appl. No.: 58,886

[22] Filed: May 10, 1993

[51] Int. Cl.[5] ..... E04C 2/20; E06B 5/00

[52] U.S. Cl. ..... 52/239; 52/309.1; 52/457; 52/588.1; 52/586.1; 52/823; 52/826; 52/DIG. 9

[58] Field of Search ..... 52/595, 593, 309.1, 52/309.2, 239, 238.1, 34, DIG. 9, 311.2, 457, 578, 266, 233, 192, 455, 458, 821, 822, 823, 826, 588.1, 586.1

[56] References Cited

U.S. PATENT DOCUMENTS

| | | | |
|---|---|---|---|
| 450,025 | 4/1891 | Jones | 52/238 X |
| 595,276 | 12/1897 | Winslow | 52/822 |
| 740,340 | 9/1903 | Van Winkle | 52/192 |
| 918,824 | 4/1909 | Caywood | 52/823 X |
| 1,374,494 | 4/1921 | Downing | 52/823 X |
| 1,479,474 | 1/1924 | Meyercord . | |
| 1,500,377 | 7/1924 | Dodson . | |
| 1,718,702 | 6/1929 | Pfiester | 52/578 X |
| 1,725,931 | 8/1929 | Perkins . | |
| 1,787,876 | 1/1931 | Sandman | 52/822 X |
| 1,841,233 | 1/1932 | Whiting | 52/595 |
| 2,553,227 | 5/1951 | Wesner | 52/595 X |
| 3,040,388 | 6/1962 | Conn | 52/823 X |
| 3,242,619 | 3/1966 | Parsons . | |
| 3,352,075 | 11/1967 | Werner et al. . | |
| 3,715,847 | 2/1973 | Straus . | |
| 3,766,574 | 10/1973 | Smid, Jr. . | |
| 3,842,556 | 10/1974 | Brendgord . | |
| 4,048,767 | 9/1977 | Ferich . | |
| 4,073,108 | 2/1978 | Williams | 52/238.1 |
| 4,301,198 | 11/1981 | Prior . | |
| 4,343,669 | 8/1982 | Prior . | |
| 4,382,108 | 5/1983 | Carroll et al. . | |
| 4,512,131 | 4/1985 | Laramore | 52/595 X |
| 4,716,056 | 12/1987 | Fox et al. . | |
| 5,165,816 | 11/1992 | Parasin | 52/595 X |
| 5,265,390 | 11/1993 | Tanner | 52/233 |

FOREIGN PATENT DOCUMENTS

| | | | |
|---|---|---|---|
| 0191604 | 9/1957 | Austria | 52/823 |
| 0237277 | 4/1964 | Austria | 52/821 |
| 323254 | 9/1957 | Switzerland | 52/823 |

*Primary Examiner*—Carl D. Friedman
*Assistant Examiner*—Robert J. Confield
*Attorney, Agent, or Firm*—Michael D. Bednarek

[57] ABSTRACT

A partition of the type commonly used in bathroom facilities. The partition is constructed of one or more panels having a construction which permits the use of a high percentage of recycled materials. The panels include a plurality of slats each having a elongated narrow construction which allows the slats to be formed by the process of pultrusion. This permits use of a high percentage of recycled materials. The slats and other components are designed such that the slats are maintained in alignment and held securely in place in the assembled state.

17 Claims, 6 Drawing Sheets

PANEL CONSTRUCTION WHICH INCLUDES SLATS OF RECYCLED PLASTIC

FIELD OF THE INVENTION

The present invention relates to a panel construction of the type commonly, but not exclusively, used in bathroom facilities to form a partition wall as in toilet compartments, urinal/vision screens and shower/dressing compartments. The invention is especially directed to a panel construction which permits the use of standardized components and recycled plastic materials and a partition which includes such structure.

BACKGROUND OF THE INVENTION

Five major types of panel constructions are currently in wide use for bathroom partitions. These are typically categorized by the material used for the door and side panels and include metal with a baked enamel finish, stainless steel, plastic laminate, solid phenolic and solid plastic. These conventional panel constructions do not make wide use of standardized parts. Instead, the panel is made of a single panel having the dimensions required for that particular application.

The baked enamel metal panel constructions consist of 20 to 22 gauge galvanized steel wall panels and door panels with a honeycomb core. The core is glued to the metal skins and the edges are covered with a locking cap molding. The finish of these panels is a baked on enamel. The advantage of this type of panel construction is its low cost. However, it is very susceptible to rusting, corrosion and vandalism. In addition, the finish can be scratched easily and the metal can be dented.

Stainless steel panels have a construction similar to that of baked enamel panels with the exception that stainless steel sheets are used in place of the galvanized steel. This provides some advantages, but also increases the cost of the panel construction. Like baked enamel panel constructions, stainless steel panel constructions are susceptible to denting. Moreover, there are several commercial cleaning solutions that will cause the stainless steel to corrode.

The plastic laminate panel constructions are made from 0.050 thick plastic laminate similar to FORMICA®. This laminate is applied to a core of particle board across both faces as well as the edges. In a high moisture environment the cores will expand and cause the laminate to come loose from the core. Although the surface is harder-than the baked enamel, once it is scratched there is no way to fix it short of replacing the entire panel.

The solid core phenolic panel constructions are typically constructed from a compression molded phenolic core with a melamine surface. In lay terms, a piece of plastic laminate that is anywhere from ½" to 1" thick with a decorative laminate on both sides. The wall and door panels are constructed of a single piece of material. Any damage to the panel requires its complete replacement.

The solid plastic panel construction now in use have door and side panels made of single sheets of compression molded high density polyethylene (H.D.P.E.). These door and wall sized sheets are made of single sheets of material are naturally quite large. The size of these panels limits the methods which can be used to form the panels; while compression molding is acceptable, extrusion or pultrusion are not practical. This in turn limits the types of material which can be used.

Non-fire rated material can be composed of up to 80% recycled products. Fire rated material is available in several colors depending on the manufacturer, but recycled products are generally not offered in fire rated material. Another disadvantage with a one-piece construction is that a separate mold must be used to change the size of the panels or large panels must be cut into smaller panels which often results in waste. Because of the current environmental awareness and emphasis on recycling—both voluntary and mandatory—the supply of recycled plastic is increasing. As a result, there is now a great emphasis on using recycled plastic as a building material, where possible. The available evidence suggests that consumers are willing to pay a premium for "environmentally friendly products"—a category which certainly includes recycled plastic. There are also intangible "corporate goodwill" benefits beyond the obvious commercial benefits, attendant to the use of recycled plastics. Thus, there remains a need for a simple, lightweight, durable partition construction which permits the use of a high percentage of recycled materials.

SUMMARY OF THE INVENTION

The panel construction of the present invention satisfies the need for a panel construction which permits the use of a high percentage of recycled products while at the same time providing a simple, durable, lightweight construction. In addition, the panel construction is modular in nature, i.e., standard parts can be used to construct panels of varying dimensions. This provides added manufacturing flexibility and reduces costs by permitting the use of standard parts instead of custom made parts to satisfy special orders or custom orders. The basic construction is the same regardless of the end use of the panel as a toilet partition; vision screen or shower/dressing compartment.

The panel construction of the present invention is constructed from panels constructed from long narrow slats, preferably tongue and groove slats. The slats are preferably formed from recycled plastic. Boards having such a long narrow construction can be formed by pultrusion or extrusion which makes it possible to use a high percentage (85% or more) of recycled plastic, even in fire rated applications. The boards preferably have a length in the range of 50" to 60"; a width of approximately 8" and are preferably about 1" thick. The slats are aligned and maintained in place by a support structure which is preferably constructed entirely from stainless steel.

In general, the panel construction of the present invention include a lower support member having a bottom slat supporting wall, and a positioning extension located between the edges if the bottom wall extending transversely upward from the bottom wall. A plurality of slats (boards) are supported on the lower support member. Each of the slats is constructed of a pultruded or extruded material composed of at least 85 percent recycled materials. Each of the slats have a length, width and thickness selected to permit the manufacture by pultrusion. Preferably the length is at least five times the width of the slat. The slats each have a pair of opposed elongated longitudinal side edges. A groove extends along one of the two longitudinal edges and a complementary tongue or protrusion is formed along the opposite side so that the edges of adjacent boards can be interlocked in a tongue and groove fashion. Each of the slats also includes a bottom edge formed with a groove for receiving the middle extension of the lower support member.

By virtue of this construction, it is possible to align the slats accurately to form a multi-board panel comprised, for example, of at least three such boards for a door panel and seven boards for a side panel.

By constructing the individual boards as specified above a problem associated with multi-board arrangements is overcome, namely the difficulty of precisely aligning individual boards. In addition, by using individual slats of a standard dimension, partition panels of various dimensions can be constructed by simply using more or less slats as is appropriate. This enables the use of a standard slat in a wide variety of applications. Moreover, the lower support member can be in the form of a metal extrusion which can be cut to length. This enables the use of standard extrusions to form the support structure for any particular application.

The slats used to form the panels of the present invention are preferably made from pultruded polyolefin high density polyethylene (H.D.P.E.). By using this material it is possible to obtain non-fire rated material composed of 95% recycled material and fire rated material with up to 85% recycled material.

A higher percentage of recycled material can be used in the slats because the slats can be made through the pultrusion or extrusion process. Pultrusion is a process by which a member is formed by pulling the base material through a die. This is to be contrasted with extrusion, i.e., pushing material through a die. The pultrusion process is conventionally used in areas involving fabrication of structural members such as channels and angles from fiberglass. Pultrusion can be used to form smaller narrow boards or slats of the type used in accordance with the present invention, but cannot practically be used to form full size panels. Another suitable method of manufacture is, in fact, extrusion. Some companies currently offer boards made of extruded plastic.

As noted above, full size panels must be made by a process such as compression molding and it is not possible with such a process to use as great a percentage of recycled materials. Accordingly, the use of individual slats to construct panels in accordance with the present invention makes it possible to use pultruded materials which in turn allows the use of a high percentage of recycled materials either non-fire rated materials or fire rated materials. Specifically, the slats of the present invention are preferably made from pultruded polyolefin high density polyethylene (H.D.P.E.). The base material is preferably 100% recycled, HDPE, but coloring and flame retardant agents are preferably added to the base material. Overall the non-fire rated material can be composed of 95% recycled material and fire rated material can be composed of up to 85% recycled material.

The use of individual slats to construct panels offers other advantages. For instance, the use of individual slats makes it possible to repair a damaged partition by simply replacing the individual slat which is damaged. This simplifies maintenance compared to conventional partition panels wherein the entire panel must be replaced if damaged. Moreover, the plastic has a homogenous coloring which doesn't show minor chips and scratches.

Preferably, the side panels and door panels are constructed from 1"×8" tongue and groove H.D.P.E. slats. The slats are joined at the top and bottom with either a stainless steel bracket wrapped over the edges of the panel or a spline set into the panel with a protective strip of stainless steel attached to the top and bottom edges of the panels. The splines and protective edges can be removed. This assembly allows a single 8" section of the panel to be replaced without the cost of replacing the complete panel. The doors will be manufactured in a similar fashion.

The panel construction of the present invention differs from known plastic partitions in at least two significant ways.

First, other commercially available plastic partitions use a single piece of material for the door panel and side panels. As a result, if damaged the entire door or side panel must be replaced.

In contrast, the partitions and doors of the present invention are made of individual 8" wide tongue and groove H.D.P.E. polyethylene boards. These will be assembled with a stainless steel top and bottom edge that will hold the boards together as a single unit. The stainless edges can be removed after the compartments are installed to allow for the replacement of individual boards if they become damaged.

Second, the polyethylene boards or slats of the present invention have a class B flame spread and smoke and are constructed of 85% recycled plastic. The use of a pultrusion system allows the use of a higher percentage of recycled plastic. Other known partitions use H.D.P.E. that is manufactured by a compression molded system that limits the use of recycled materials.

DETAILED DESCRIPTION

Figure 2:
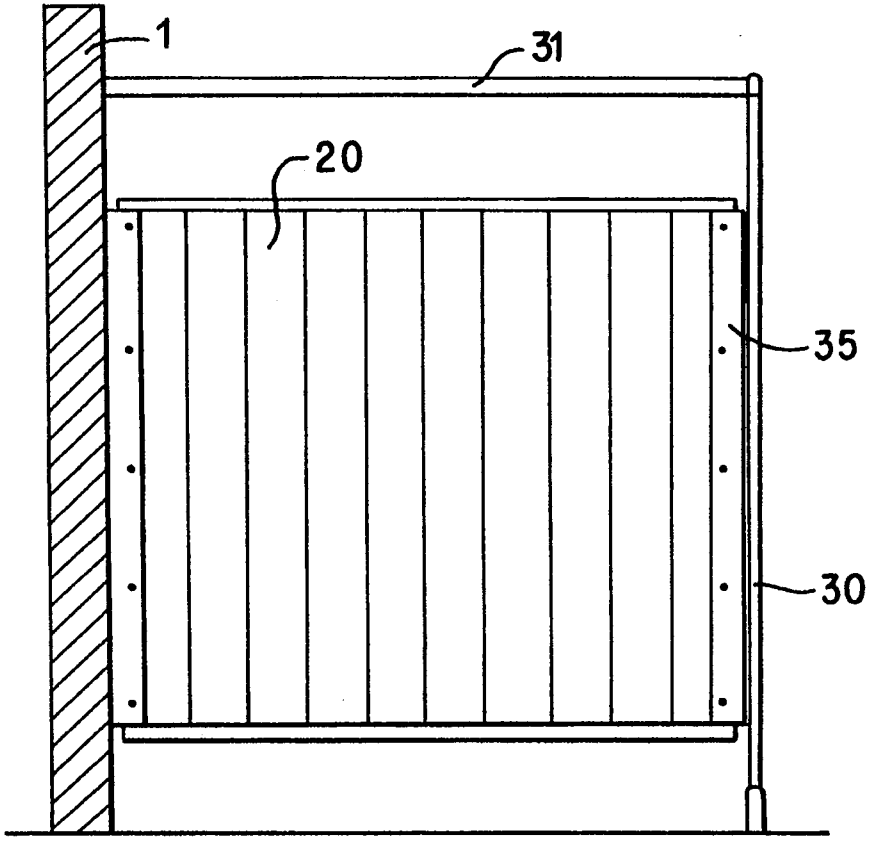
FIG. 2 is a side elevation of the partition of FIG. 1 showing the side panel, the front pilaster and the attachment of the side panel to a wall.
Figure 1:
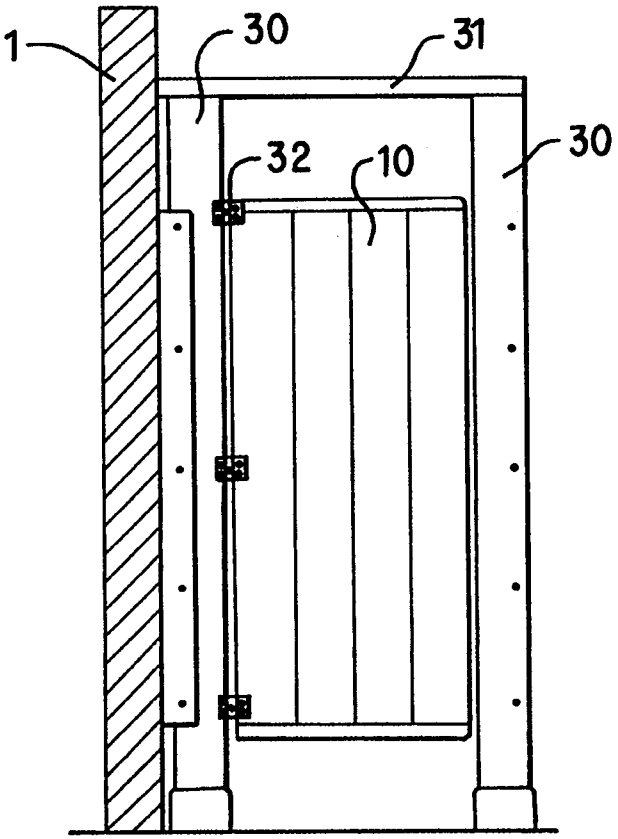
FIG. 1 is a front elevation of a partition using the panel construction of the present invention showing the door and front pilasters.
Figure 4:
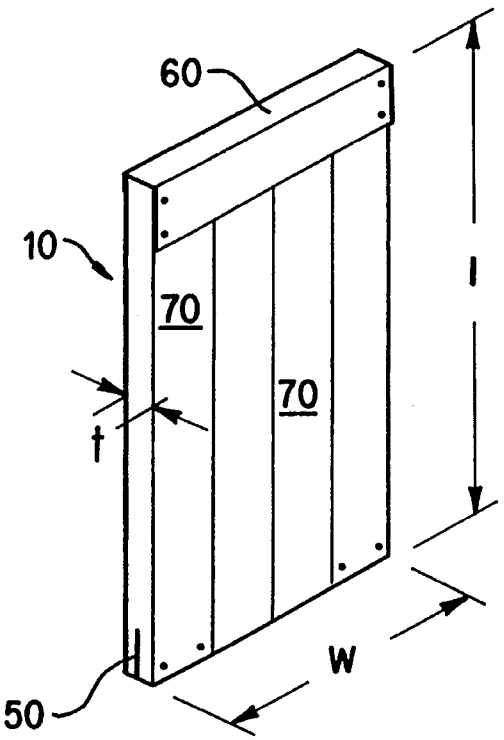
FIG. 4 is a perspective view of a door panel construction according to the present invention.
Figure 3:
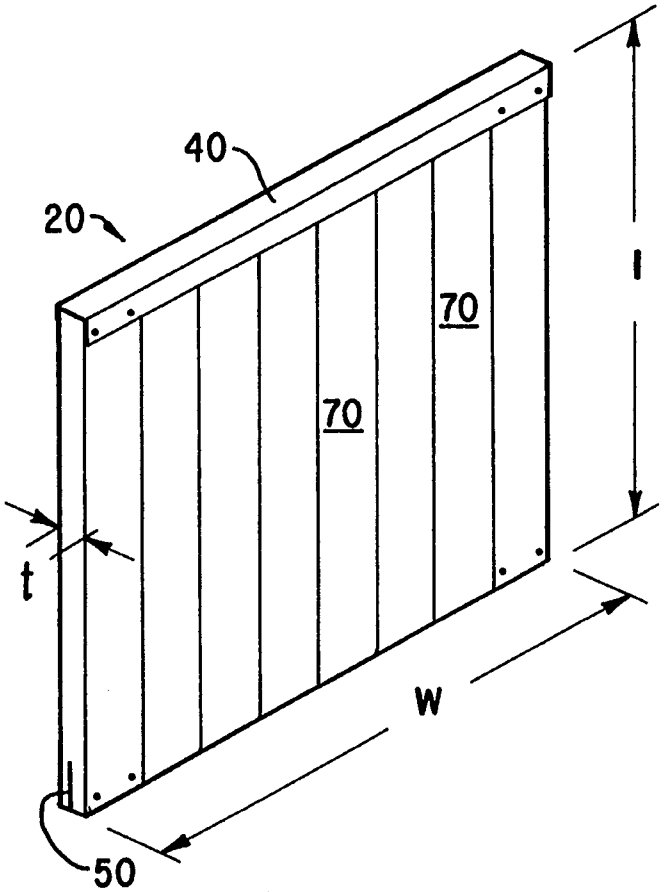
FIG. 3 is a perspective view of a panel construction according to the present invention for use as a side panel.

The panel construction of the present invention is constructed from a number of standard components. The panel construction is then preferably used in a bathroom partition as shown in FIGS. 1 and 2. Representative side and door panel constructions are shown in FIG. 3 and 4 respectively and the standard components themselves are shown in FIGS. 5–8C.

The partition assembly shown in FIGS. 1 and 2 includes a door panel 10 and one or more side panels 20 as in a conventional partition. The partition construction according to the present invention differs from conventional partitions primarily in the use of the door panel 10 and side panel 20 constructions of the present invention. The door panel 10 and side panel 20 are supported on pilasters 30 which are typically secured in a known fashion to a building wall 1. The pilasters 30 have a generally conventional construction; they are rectangular in plan and have a relatively narrow width. The pilasters 30 are typically mounted in a support on the floor of the building. In accordance with the present invention, however, the pilasters may be formed of the same pultruded or extruded plastic material as the panel slats discussed below.

The door panel 10 is secured to a front pilaster 30 by a plurality of hinges 32, in this case 3. The hinges are preferably constructed of stainless steel for improved corrosion resistance.

As best shown in FIG. 2, the side panel 20 is secured to a pilaster 30 at one end and the building wall 1 at the other end by a mounting bracket 35 which, again, is preferably formed of stainless steel.

The partition assembly preferably also includes headrails 31 for additional support.

FIG. 3 shows the construction of a panel according to the present invention. As shown, the panel is constructed from standard components. Specifically, the panel includes a bottom bracket or lower support member 50. This bottom bracket or lower support member 50 may be formed as an extrusion which can be cut to appropriate lengths in the field using conventional cutting equipment. Alternatively, the bottom bracket can be formed from two separate extrusions. These bottom bracket constructions are shown in FIGS. 7–7B. In the first construction shown in FIG. 7, the bottom bracket or lower support member 50 includes a base wall 51, a side wall 53 extending transversely upward from the base wall 51 and a middle guide wall 52 extending transversely upward in the same direction as the side wall 53 from a location between the side edges of the bottom wall 51. As discussed below, the middle guide wall acts as a positioning extension to align the slats of the panel construction. Naturally, other forms of positioning extensions could be used, but the wall type is preferred because of its simplicity.

Figure 7A:
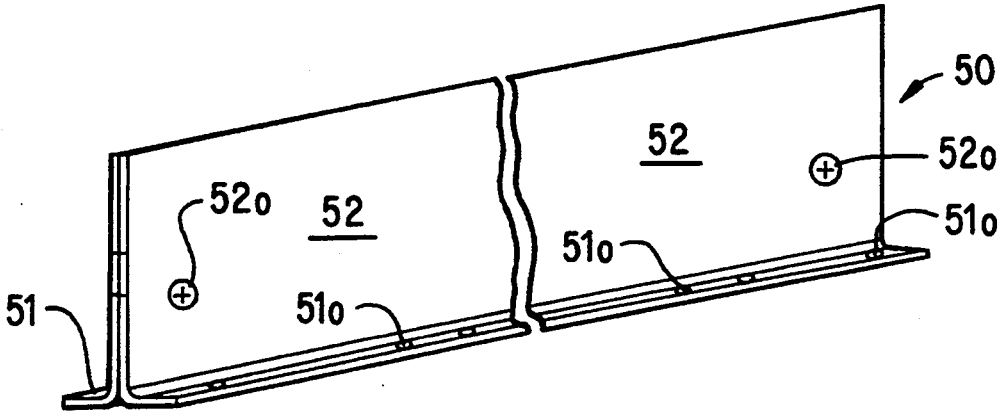
FIG. 7A is a perspective view of an alternative, preferred, bottom bracket construction according to the present invention.
Figure 7:
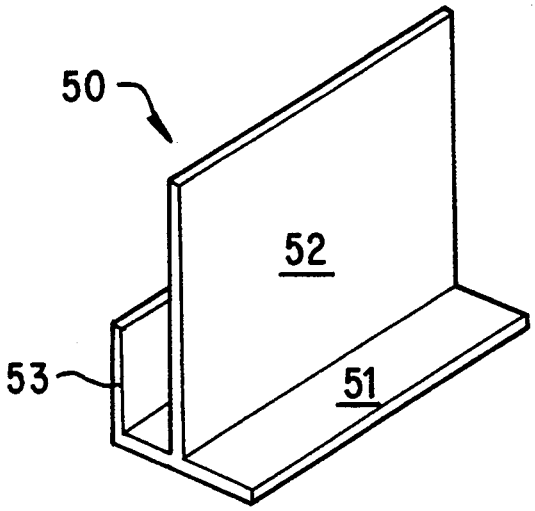
FIG. 7 is a perspective view of a panel and door bottom bracket used as the lower support member in the panel construction of the present invention.
Figure 7B:
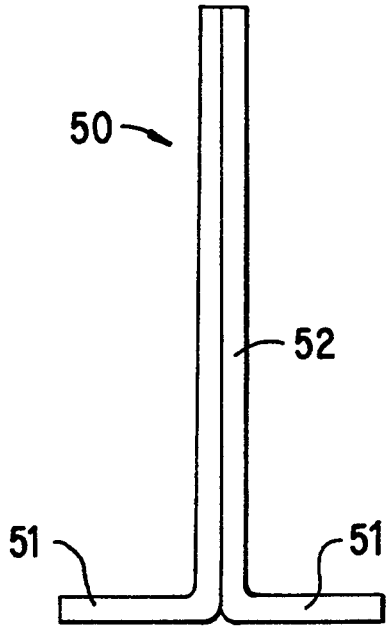
FIG. 7B is an end view of the bottom bracket of FIG. 7A.

The second, preferred, construction is shown in FIGS. 7A and 7B. This bottom bracket or lower support member is made from two pieces of metal, preferably 16 gauge stainless steel. Each piece of steel is bent into an L shape with a long leg and a short leg. Two L shaped units are then secured, as by tack welding, to form the bottom bracket or lower support member 50 shown in FIGS. 7A and 7B. The bracket 50 includes a bare wall 51 and a middle guide wall 52 extending transversely upward from the bare wall 51.

As shown in FIG. 7A, the bracket or support member 50 includes openings 520 in the middle guide wall 52 and openings 510 in the base wall 51. These openings facilitate attachment of the bracket to the slats or boards 70 in the panel construction.

In the preferred embodiment shown in FIG. 7A three openings 510 are located at each end of the lower support. The openings are spaced such that in the assembled state the openings are located about one inch from the end of a slat. Thus when, as shown, three openings are provided at each end of the bottom bracket an opening is provided at either end of the endmost slat and at the outer end of the penultimate slat. By securing the slats at either end in this way all of the slats in the panel construction are maintained in position and alignment because of the interlocking configuration of the slats and the positioning extension.

Figure 6:
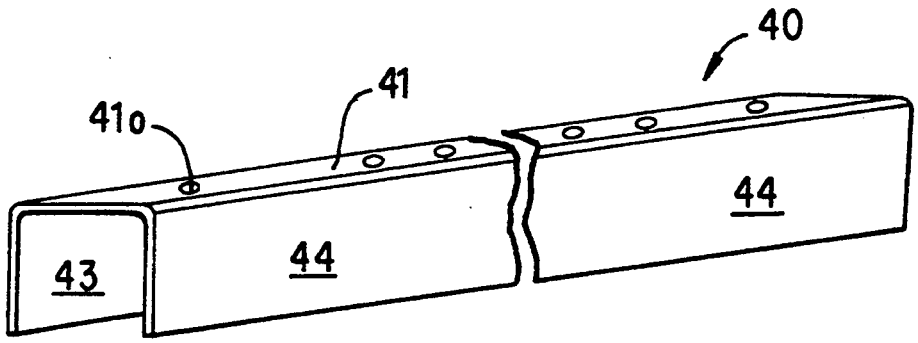
FIG. 6 is a perspective view of a panel top bracket for use in the panel construction of the present invention.
Figure 6A:
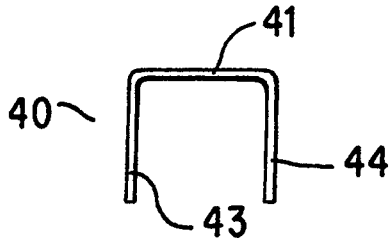
FIG. 6A is an end view of the top bracket shown in FIG. 6.
Figure 6B:
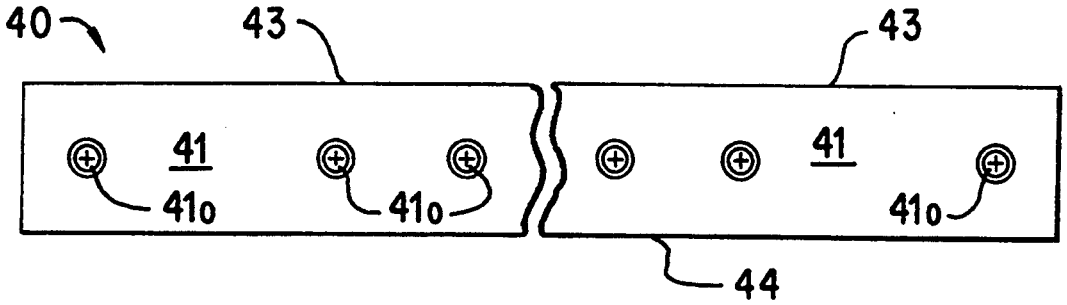
FIG. 6B is a top view of the top bracket shown in FIG. 6.

The panel shown in FIG. 3 further includes a top bracket 40 having a channel shape. As shown in FIGS. 6–6B the top bracket includes a top bracket top wall 41 and opposed side walls 43, 44 extending transversely down from the top wall 41. A plurality of openings 410 are formed in the top wall 41 to facilitate attachment to the slats or boards 70. The openings 410 are spaced to receiving screws such that, in the assembled state, the screws are spaced about an inch from both ends of the outermost slat and an inch from the outermost edge of the penultimate slat.

In addition, the panel shown includes a plurality of, in this case eight, boards or slats according to the present invention. The construction of these boards or slats is described in detail below in connection with FIGS. 5–5E. The boards or slats are aligned, in part, by virtue of the middle wall 52 of the bottom bracket which is received in a slot or groove **76*s*** formed in each of the boards or slats.

Thus, the panel is assembled by aligning the boards or slats 70 along the bottom bracket. This alignment is maintained by virtue of the middle wall 52, i.e., positioning extension, and the tongue and groove connection between adjacent boards as described below. The top bracket is then placed over the aligned slats or boards and screws, preferably stainless steel, are driven through the top bracket and bottom bracket into, at least, the slats at either end of the panel to maintain the entire assembly in the assembled state.

As shown in FIG. 4, the door panels of the present invention have a construction very similar to that of the side panels. One difference between the doors and the panels is, naturally, the width of the assembly. As shown in FIG. 4, the door assembly includes only four slats or boards 70 and is thus only half as wide as the panels. The door panels and side panels can be made any desired width by simply using more or less slats or boards 70 as the case may be and dimensioning the top and bottom brackets as appropriate. Thus, the basic panel construction of the present invention can be adapted to a variety of bathroom partition applications including toilet compartment, urinal/vision screens and shower/dressing compartments.

As shown in FIG. 4, the door assembly includes a slightly different top bracket construction. The construction of the door bracket is shown in detail in FIGS.

Figure 8:
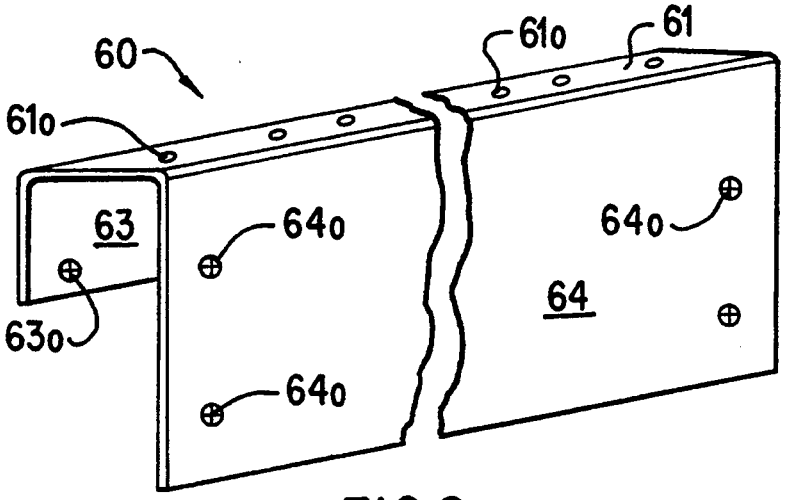
FIG. 8 is a perspective view of a top door bracket.
Figure 8A:
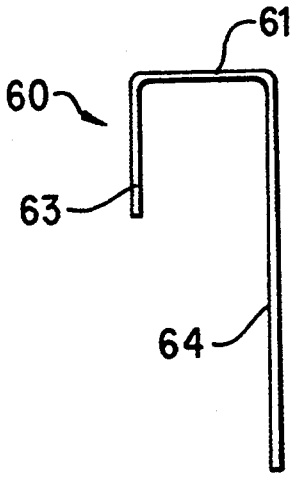
FIG. 8A is an end view of the top door bracket of FIG. 8.
Figure 8C:
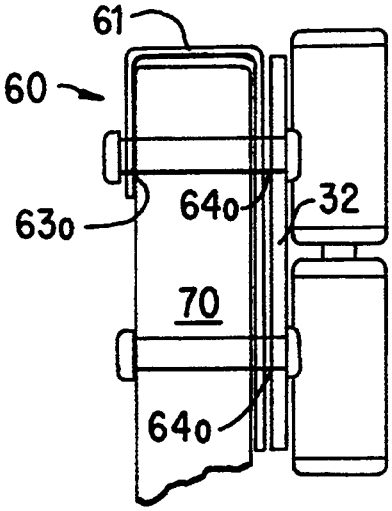
FIG. 8C is a sectional view showing a top door bracket and a hinge secured to a slat.
Figure 8B:
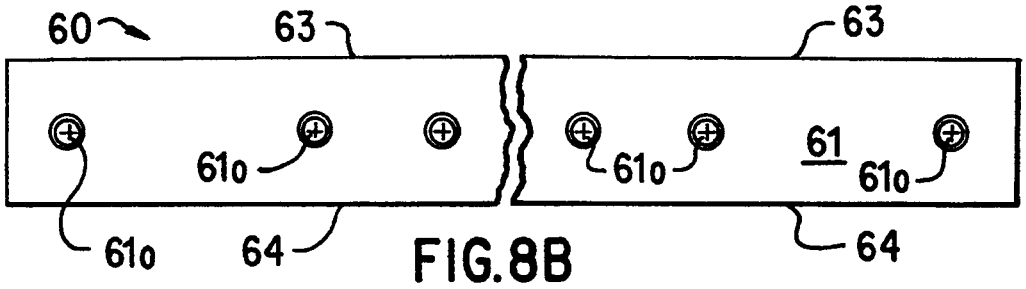
FIG. 8B is a top view of the top door bracket of FIG. 8.

8–8C. As shown therein, the door bracket includes a top wall 61 and opposed side walls 63 and 64. In this case, however, one of the side walls 64 is significantly longer than the other side wall. This permits the hinges 32 to be secured with through bolts to the panel construction through both the top bracket 60 and a slat 70 as shown in FIG. 8C.

Figure 5:
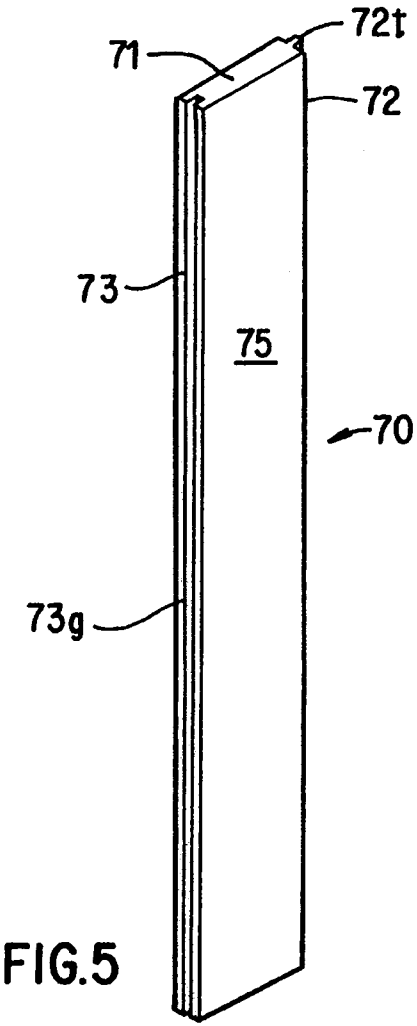
FIG. 5 is a perspective view of a board or slat used in the panel construction of the present invention.
Figure 5A:
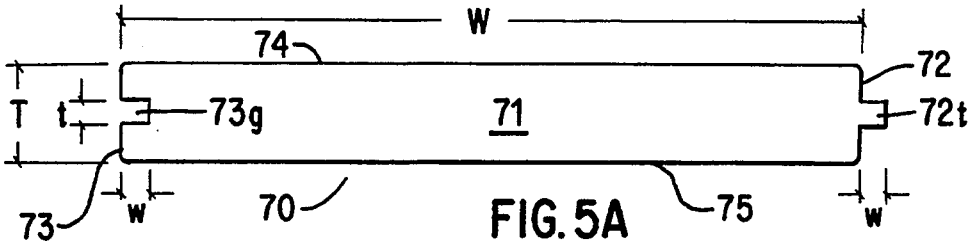
FIG. 5A is a top view of the slat or board of FIG. 5.
Figure 5B:
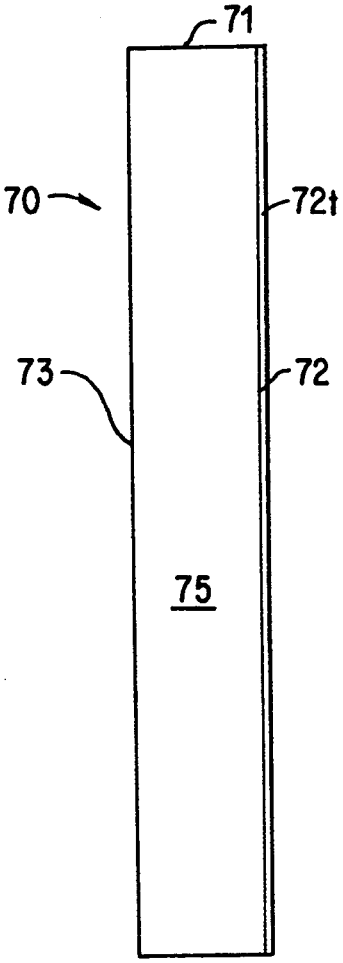
FIG. 5B is a side view of the slat or board of FIG. 5.
Figure 5C:
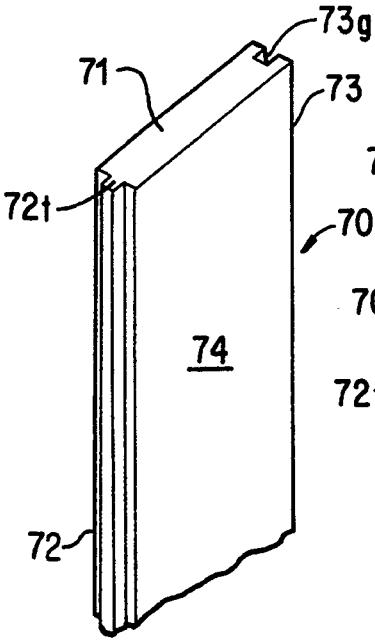
FIG. 5C is a perspective detail view of the top of the slat or board of FIG. 5.
Figure 5D:
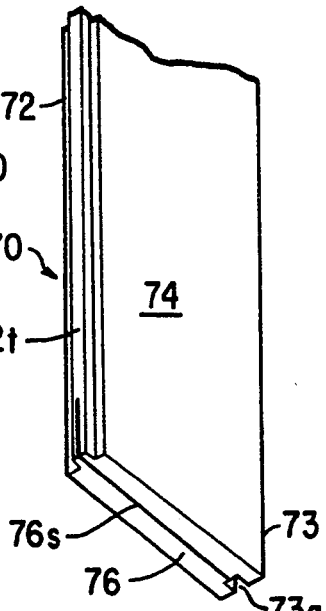
FIG. 5D is a perspective detail view of the bottom of the slat or board of FIG. 5.
Figure 5E:
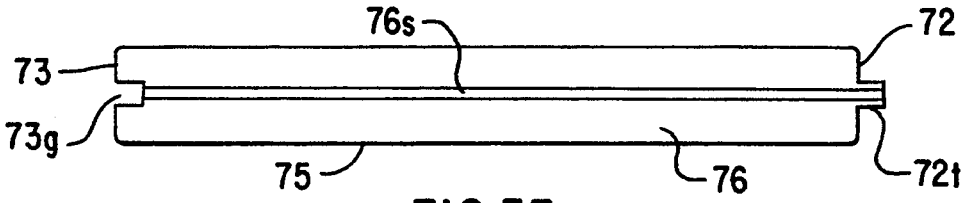
FIG. 5E is a bottom view of the slat or board of FIG. 5.

The construction of the standard board or slat used in the partition of the present invention is shown in FIGS. 5–5E. The construction of this board or slat as a standard member is a particularly important aspect of the present invention. It allows an entire door or panel to be assembled from identical standard parts. In addition, because of its relatively narrow construction, it is possible to form these members by the process of pultrusion or extrusion using a high percentage of recycled materials, even in a fire-rated construction.

As best shown in FIGS. 5A, 5B and 5E, the standard board or slat 70 has an elongated configuration. Specifically, the board or slat has a length L, a width W and a thickness T. The dimensional relationships between length, width and height should be selected such that the slat can be formed of recycled materials by protrusion or extrusion. Since the length L is generally a standard length of, for example, 55" to satisfy the needs for the normal application, namely toilet partitions, the other values follow from that standard value. More specifically, in accordance with an aspect of the present invention, the width of the slats should not be more than 1/5 the length of the slats preferably in the range of 1/5th to 1/10th the length of the slats. Moreover, the thickness should also be no more than 1/5th the length of the board and is preferably much thinner on the range of 1/50th the length of the board. A board of such dimensions having a length of, for example, 50", a width of 5" and a thickness of 1" can be pultruded or extruded using conventional methods and using a high percentage of recycled materials.

As shown in FIGS. 5–5E, the slats each include a top edge 71, opposed side edges 72, 73, front and back edges 74 and 75 respectively and a bottom edge 76. The opposed side edges 73 is formed with a depression, in this case groove **73*g*, which extends along the entire length of the board. The opposite side edge 72 is formed with a tongue or protrusion 72*t* having a shape which is complementary to the shape of the groove 73*g* such that when assembled the tongue or protrusion 72*t* of one slat or board 70 is received in a complimentary fashion in the groove 73*g* of the adjacent board or slat 70. This serves to align and interlock adjacent boards 70** in the assembled state.

To further aid alignment, a slot **76*s* is formed in the bottom wall 76 of the slat. In the assembled state, the slot 76*s* receives the positioning extension, i.e., middle wall 52**, of the bottom bracket so as to positively retain and align the lower edge of the slat. The width of the slot should be about one half the thickness t of the tongue, i.e., about ⅛th inch in the preferred embodiment.

As noted above, the specific configuration and dimensions of the slats or boards is an important aspect of the present invention. Preferably, the thickness T of the tongue or protrusion **72*t* is no more than ⅓ of the thickness T of the slat 70. For example, in the preferred embodiment wherein the slat 70 is one inch thick the tongue 72*t* is ¼ inch thick. The groove 73*g*** has the same dimension as the tongue to ensure a tight fit.

As shown in FIGS. 5A and 5E, the side edge 72 may be tapered inward, preferably by about 5° from a right angle. This ensures that the outside surfaces of adjacent slats are flush to improve appearance.

As noted above, the slats or boards are preferably formed from a recycled material. Because the slats or boards are dimensioned such that they can be formed by pultrusion or extrusion, it is possible to form the slats or boards with 85% or more recycled material. The composite mixture preferably uses both post-consumer and post-industrial material. By using only non-co-mingled pultruded products, a network of complete molecular linkage can be ensured to eliminate stress cracking and material separation due to severe temperature changes.

The pilasters can also be formed of recycled material. The slats or boards are preferably formed of pultrusion polyolefin high density polyethylene (H.D.P.E.). Non-fire rated material can be composed of 95% recycled material and fire-rated material can be provided with up to 85% recycled material.

The present invention as described heretofore offers a number of advantages over conventional constructions. First, by virtue of the construction from a number of long narrow members, it is possible to form the slats as well as the pilasters from pultruded materials using recycled products. Thus, it is possible to make great use of recycled products in constructing the partition of the present invention. This obviously has advantages in terms of environmental consciousness.

In addition, the partitions of the present invention can be constructed to a variety of dimension using standard parts. In other words, a series of identical slats or boards can be used to construct a variety of different sizes of door panels or side panels or whatever type of panel is needed for a particular application. Moreover, standard metal extrusions can be used for the panel, top bracket panel, bottom bracket and top door bracket since these members have a constant cross-section and can simply be cut to size. The ability to use standard components to make the partitions of the present invention makes it possible to achieve economies of scale and serve special order needs which would otherwise be very expensive.

Finally, the panel construction of the present invention offers improved maintenance. Specifically, if a small portion of the panel is damaged, it is only necessary to remove the damaged slats or slats and it is not necessary to replace the entire panel as is the case with conventional panels.

As further description of the present invention, a description of the currently preferred embodiment will now be made. It should be understood that the present invention is not limited to the specifics of this currently preferred embodiment.

I claim:

1. A panel construction for use in bathroom facilities that is formed primarily from recycled plastic, the panel construction comprising:

a lower support member having a bottom support wall with two opposed sides, two side edges extending between the sides and a positioning extension located between the side edges and extending transversely upward from one side of the lower support member;

a plurality of substantially identical slats each having a length, width and thickness supported on the lower support member, each slat being constructed of a material containing at least 80 percent recycled plastic materials, each slat having opposed slat side edges, a front and back slat surface and top and bottom slat walls; wherein a groove is formed along the length of one of the opposed slat side edges of the slats and a complementary protrusion is formed along the opposed slat side edge of the slats so as to be received in the groove of an adjacent slat in the assembled state and wherein a slot is formed in the bottom slat wall of each of the slats so that each slat can receive the positioning extension of the lower support member;

a top bracket including a bracket top wall and two bracket side walls extending transversely downward from the bracket top wall along the front and back slat surfaces of the slats;

whereby the panel construction includes a top edge defined by the top bracket, a bottom edge defined by the lower support member and walls defined by the slats constructed of at least 80 percent recycled plastic material such that the panel is constructed primarily from recycled plastic materials; and wherein the lower support member and top bracket support the slats such that the slats can be slid along the lower support member and the top bracket to permit removal and replacement of the slats.

2. The panel construction of claim 1, wherein the slats are formed from a pultruded plastic comprising at least 85% recycled materials.

3. The panel construction of claim 1, wherein the slats are formed from an extruded plastic material comprising at least 85% recycled materials.

4. The panel construction of claim 1, wherein the length of each of the slats is at least five times the width of the slat.

5. The panel construction of claim 1, comprising at least three slats.

6. A panel construction of the type used in bathroom facilities that is formed primarily of plastic material, the panel construction having replaceable plastic slats such that plastic sections of the panel construction may be removed and replaced without replacing other plastic sections of the panel construction, the panel construction comprising:

a lower support member, the lower support member including a planar bottom support wall having two sides and edges extending between the two sides and a guide member extending substantially perpendicular from one of the two sides at a location between the two side edges;

at least three long narrow plastic slats aligned edge to edge and supported on the lower support member, each of the plastic slats having two sides, a top edge, a bottom edge and two lateral side edges which extend between the sides of the plastic slats from the top edge to the bottom edge of the plastic slats, the bottom edge of each of the plastic slats being formed with a slot which is spaced from the sides of the plastic slat and extends from one lateral side edge to the other lateral side edge of the plastic slat, the plastic slats receiving the guide member of the lower support member such that the bottom edge of each of the plastic slats rest on and is supported by the planar bottom support wall and the guide member maintains the alignment of the respective plastic slats with respect to one another while allowing the plastic slats to slide along the guide member, each of the plastic slats further comprising a protrusion extending from one lateral edge and a complementary depression formed on the opposite lateral edge such that adjacent plastic slats are interlocked by insertion of the protrusion of one slat in the depression of an adjacent plastic slat whereby the adjacent plastic slats are aligned with respect to one another, but slidable in at least a direction parallel to the top edge of the slats whereby one plastic slat of the panel construction may be replaced without replacing other plastic slats; and a top retaining member having a planar top wall extending across the top edge of the plurality of aligned slats, the top retaining member further comprising at least one side wall extending transversely from the top wall along one of the sides of the plurality of plastic slats; and a retainer extending through the top retaining member and into the sidemost plastic slats so as to firmly locate and retain the slats in place;

whereby the plastic slats extend from the top retaining member of the panel construction to the lower support member of the panel construction such that the panel construction is formed primarily of plastic material.

7. The panel construction of claim 6, wherein the depressions formed in the slats are in the form of a longitudinal groove extending along the lateral edge of the slats and the protrusions are in the form of a longitudinal tongue having a shape which is substantially complementary to the longitudinal groove.

8. The panel construction of claim 6, wherein each of the slat is formed of a pultruded plastic material containing at least 85% recycled material such that the panel construction is formed primarily of recycled plastic material.

9. The panel construction of claim 6, wherein the retainer extending between the top retaining member and the slats is a screw.

10. The panel construction of claim 6, wherein the top retaining member and lower support member are both formed of stainless steel.

11. The panel construction construction of claim 6, wherein all of the slats are of substantially identical construction.

12. The panel construction of claim 6, wherein each of the slats have a predetermined length, width and thickness and wherein the length of each of the slats is at least five times the width of that slat and at least twenty times the thickness of that slat.

13. A panel construction formed primarily of recycled plastic material and having replaceable slats such that plastic sections of the panel construction may be replaced without replacing other plastic sections of the panel construction, the panel construction having two sides, a top edge, a bottom edge and the two side edges and comprising:

a plurality of long narrow plastic slats, each of the plastic slats having opposed sides, top and bottom edges and opposed lateral edges that extend between the sides of each plastic slat from the top edge to the bottom edge, the plurality of plastic slats being interlocked with one another along the respective lateral edges of the plastic slats such that the plastic slats are aligned with respect to one another, but slidable relative to other plastic slats in a direction parallel to the plane of the top and bottom edges whereby a plastic slat at one edge of the panel construction may be removed from the panel construction without removing an adjacent plastic slat; the panel construction further comprising top and lower support members for supporting and maintaining the alignment of the slats, the lower support member supporting the bottom edge of the slats and maintaining the alignment of the slats with respect to one another and the top support member extending across the top edges of the aligned slats; wherein each of the slats are substantially identical to one another in construction and are formed of a plastic material that contains at least 85% recycled plastic such that the panel construction is formed primarily of recycled plastic materials.

14. The panel construction of claim 13, wherein each of the slats is formed with a tongue extending along one lateral edge and a groove extending along the opposite lateral edge wherein the tongue and groove are substantially complementary such that the plurality of slats are interlocked by the extension of one tongue member into the groove of an adjacent slat.

15. The panel construction of claim 13, wherein the length of each of the slats is at least five times the width of the slat and at least twenty times the thickness of the slat so that the slat has a shape which is capable of pultrusion.

16. The panel construction of claim 13, wherein the lower support member and top retaining member are both formed of stainless steel.

17. The panel construction of claim 13, further comprising a plurality of screws extending through the top retaining member and to the slats located closest to the side edges of the panel construction so as to retain the slats in the panel construction.

* * * * *